US005387904A

United States Patent [19]

Takada

[11] Patent Number: 5,387,904

[45] Date of Patent: Feb. 7, 1995

[54] PAGER TERMINAL DEVICE CONNECTABLE TO A HOST APPARATUS

[75] Inventor: Yuji Takada, Nara, Japan

[73] Assignee: Sharp Kabushiki Kaisha, Osaka, Japan

[21] Appl. No.: 22,122

[22] Filed: Feb. 25, 1993

[30] Foreign Application Priority Data

Feb. 27, 1992 [JP] Japan ..... 4-040915

[51] Int. Cl.[6] ..... G08B 5/22

[52] U.S. Cl. ..... 340/825.44; 379/57

[58] Field of Search ..... 340/825.44, 311.1; 379/56, 57

[56] References Cited

U.S. PATENT DOCUMENTS 5,043,721 8/1991 May ..... 340/825.44
5,257,307 10/1993 Ise ..... 340/825.44
5,281,962 1/1994 Vanden Heuval et al. ... 340/825.44

FOREIGN PATENT DOCUMENTS 232325 of 1991 Japan .

*Primary Examiner*—Michael Horabik
*Attorney, Agent, or Firm*—David G. Conlin; Henry D. Pahl, Jr.

[57] ABSTRACT

A pager terminal device is provided with a receiver circuit, an electronic memory for storing an application program by which received pager-use data are effectively utilized, and a single connector for connecting the receiver circuit and the electronic memory to a host apparatus. This arrangement obviates the necessity of installing an external storage device for storing the application program, and still maintains the portability of the host apparatus. The pager terminal device is further provided with: a connection-discriminating circuit for discriminating the connected state between the pager terminal device and the host apparatus; and an input switching circuit for switching input channels for the pager terminal device so as to provide a connection to the key section of the pager terminal device or to the key section of the host apparatus, in cooperation with the connection-discriminating circuit.

12 Claims, 6 Drawing Sheets

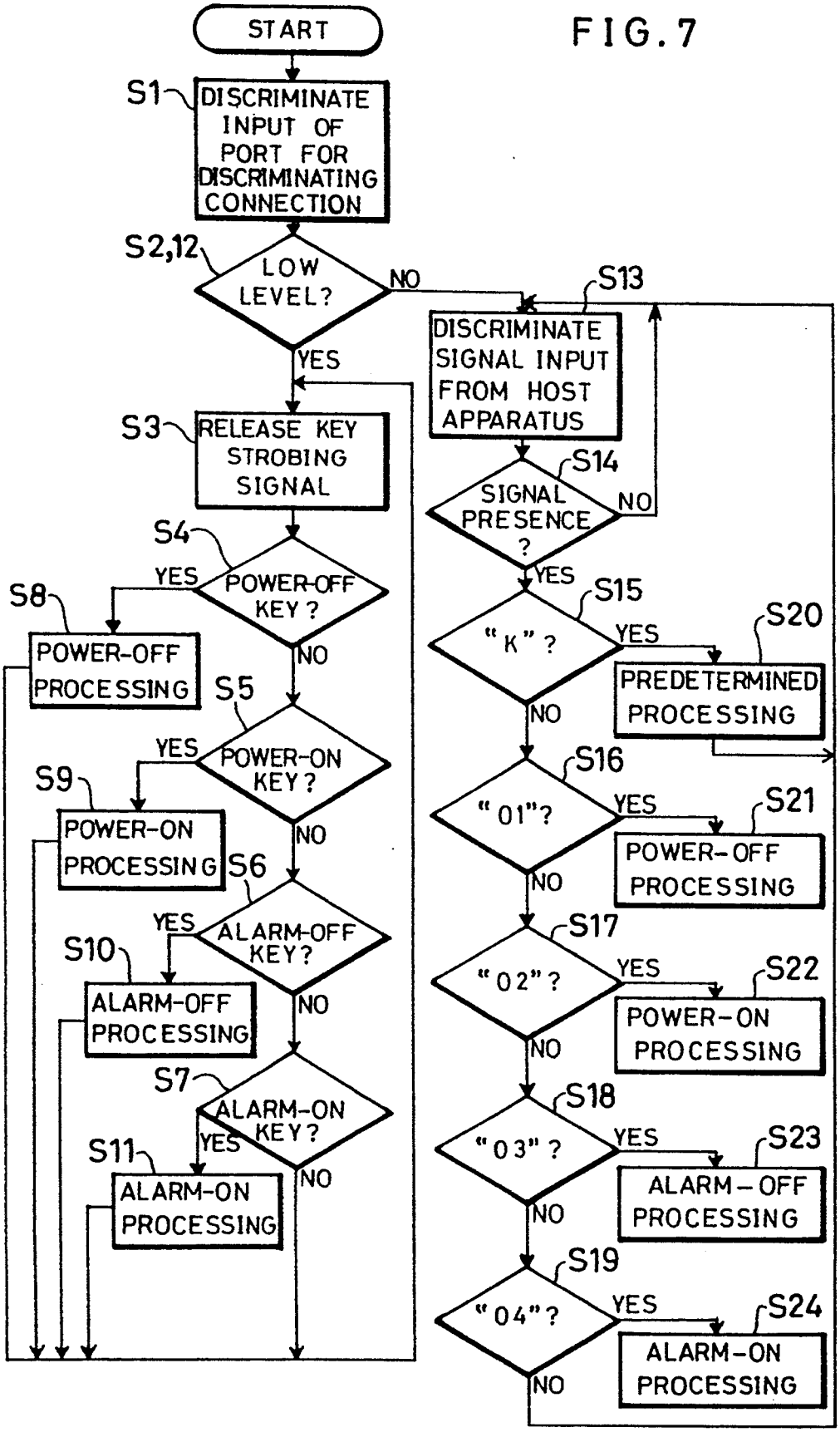
FIG. 7
START
S1
DISCRIMINATE INPUT OF PORT FOR DISCRIMINATING CONNECTION
S2,12
LOW LEVEL?
NO
YES
S3
RELEASE KEY STROBING SIGNAL
S4
POWER-OFF KEY?
YES
NO
S8
POWER-OFF PROCESSING
S5
POWER-ON KEY?
YES
NO
S9
POWER-ON PROCESSING
S6
ALARM-OFF KEY?
YES
NO
S10
ALARM-OFF PROCESSING
S7
ALARM-ON KEY?
YES
NO
S11
ALARM-ON PROCESSING
S13
DISCRIMINATE SIGNAL INPUT FROM HOST APPARATUS
S14
SIGNAL PRESENCE ?
NO
YES
S15
"K"?
YES
NO
S20
PREDETERMINED PROCESSING
S16
"01"?
YES
NO
S21
POWER-OFF PROCESSING
S17
"02"?
YES
NO
S22
POWER-ON PROCESSING
S18
"03"?
YES
NO
S23
ALARM-OFF PROCESSING
S19
"04"?
YES
NO
S24
ALARM-ON PROCESSING

PAGER TERMINAL DEVICE CONNECTABLE TO A HOST APPARATUS

FIELD OF THE INVENTION

The present invention relates to pager systems by which, for example, a registered caller calls a desired pager terminal unit by accessing a pager relay base through the public telephone line and more particularly to a pager terminal unit that is used for the above pager systems.

BACKGROUND OF THE INVENTION

Generally, in pager systems, a pager relay base receives an access code and a message from a registered caller and radios them in a predetermined communication format; the sequence of these operations are explained as follows:

(1) The caller accesses the pager relay base using the public telephone line.

(2) The relay base informs the caller of the sequence of the calling operations according to a predetermined program.

(3) Since the pager, which is carried by the recipient of a particular call, stores an access code that is exclusive to the caller, the caller enters the access code through push buttons on the phone or other means in accordance with the sequence of the calling operations.

(4) The caller enters a message to be sent to the recipient in accordance with the sequence of the calling operations.

Here, the pager refers to a portable receiver that is used in such a pager system (a receiver having a selective calling function).

In recent years, with the development of semiconductor devices and advanced packaging technology for parts, it is possible to integrate a receiver circuit for use in a pager into a thin package in the shape of an IC card. Further, pager systems have developed in such a manner that a pager is used not only for calling a recipient who is out or not at his desk by using methods such as sound, vibration, display through radio waves, but also for receiving characters, figures, etc. More specifically, in the near future in our country, information-supplying services involving stock prices, weather forecasts, results of sport games, etc., wherein a quick report is necessary, will be put into practice through pager systems.

In response to this trend, various application programs to utilize information supplied by pager systems (hereinafter, referred to as pager-use data) have been suggested. For example, a pager can be connected to a personal computer with a floppy disk drive; thus, received data is effectively utilized by the use of the floppy disk. However, this usage will impair the feature of portability of the pager. Here, it has been suggested that the above-mentioned receiver circuit integrated into an IC card be connected to portable electronic apparatuses such as book-type personal computers and electronic system notebooks.

However, in order to provide the user with an application program by which pager-use data can be utilized, the conventional portable electronic apparatus, such as an electronic system notebook, needs to be connected to a card-type external storage device (so-called ROM card) storing the application program as well as being connected to a card-type receiver circuit. For example, a conventional electronic system notebook is provided with only one connecting section for an IC card. Therefore, when a card-type receiver circuit for receiving pager-use data is connected to the connecting section, a ROM card can no longer be connected.

To solve this problem, two types of connecting sections may be provided in a portable electronic apparatus in order to attach both the card-type receiver circuit and the ROM card thereto. However, this structure will arise another serious problem wherein the features of compactness and portability of the portable electronic apparatus are impaired. Moreover, both the IC card for use in pager systems and the ROM card that is originally attached to the portable electronic apparatus need to be prepared; this might result in a problem wherein a mismatched ROM card is applied to the IC card, that is, an incorrect combination of application programs might be used.

In the United States, inputs and outputs of pager-use data are processed by a system wherein an existing pager terminal device is provided with a connecting-use interface through which it is connected to a personal computer. Most pager terminal devices of this type are provided with a power key and an on-off key for alarm, and can receive pager-use data even when they are used alone as one unit. Here, if pager terminal devices of this type are modified into pager cards, and connected to an electronic system notebook, a portable pager system can be provided. In this case, a slot may be installed in the electronic system notebook to provide a function for connecting the pager card to the electronic system notebook.

However, in order to operate the power key and the on-off key of the pager card with the pager card inserted into the electronic system notebook, further modifications in structure need to be taken into consideration. Moreover, other structural device need to be adopted so as to connect the pager card to the electronic system notebook; this results in a problem wherein the shape and styling design of the electronic system notebook are greatly limited. Furthermore, if the pager card is attached to the electronic system notebook in a protruding manner so that those keys are exposed, the keys will be located at rather awkward positions, thereby reducing the operability of the system.

SUMMARY OF THE INVENTION

The primary object of the present invention is to provide a pager terminal device which has superior operability and which is readily connectable to a host apparatus without requiring any special equipment in the host apparatus, that is, without impairing the portability of the host apparatus.

In order to achieve the objective, the pager terminal device of the present invention, which is connected to a host apparatus as a portable electronic apparatus, having a central processing unit and a storage device wherein a system controlling program is stored, is provided with at least the following means.

(1) a thin casing.

(2) a receiver circuit for receiving and processing a radio signal that is released from a pager relay base.

(3) an electronic memory (for example, ROM) for storing an application program that controls the signal processing operation of the host apparatus.

(4) a single connector for connecting the electronic memory and the receiver circuit to the host apparatus mechanically as well as electrically.

Here, the receiver circuit, the electronic memory and the connector are housed in the casing.

In the above-mentioned arrangement, data, which have been processed in the receiver circuit, are taken into the host apparatus according to the application program, where the central processing unit conducts predetermined processings such as storing and displaying with respect to the data. Thus, the pager terminal device of the present invention, which is provided with the electronic memory for storing an application program that controls the signal processing operation of the host apparatus, does not require any external storage device, such as a ROM card, which needs to be separately installed. This arrangement makes it possible to prevent the problem caused by using a pager terminal device in combination with an improper application program.

Further, the pager terminal device is provided in the shape of a thin casing, and connected to the host apparatus through a single connector; this arrangement makes it possible to maintain the portability of the host apparatus and provide easy connection between the pager terminal device and the host apparatus.

Here, the central processing unit of the host apparatus controls the entire system by using the system controlling program that is stored in the storage device; therefore, the electronic memory merely needs to store the application program. This results in a low manufacturing cost of the pager terminal device.

In order to achieve the above objective, the other pager terminal device of the present invention, which is connected to a host apparatus, as a portable electronic apparatus, having a central processing unit, a storage device for storing a system controlling program and an operator console, is provided with at least the following means.

(1) a receiver circuit for receiving and processing a radio signal that is released from a pager relay base.

(2) a key section through which instructions are entered to the pager terminal device.

(3) a pager-use central processing unit for controlling the entire pager terminal device in accordance with the built-in controlling program.

(4) a connector for connecting the pager-use central processing unit and the receiver circuit to the host apparatus mechanically as well as electrically.

(5) connection-discriminating means for discriminating whether the connector is connected to or disconnected from the host apparatus.

(6) input switching means for switching input channels in such a manner that an input signal entered through the key section is supplied to the pager-use central processing unit when the response (i.e., the discrimination result) of the connection-discriminating means shows "disconnection" and that an input signal entered through the operator console is supplied to the pager-use central processing unit when the response (i.e., the discrimination result) of the connection-discriminating means shows "connection".

In accordance with the above arrangement, when the connection-discriminating means discriminates that the pager terminal device is not connected to the host apparatus, the input switching means switches the input channels so that an input signal entered through the key section is inputted to the pager-use central processing unit. Therefore, the pager terminal device of the present invention has an independent receiving function.

Further, when the connection-discriminating means discriminates that the pager terminal device is connected to the host apparatus, the input switching means switches the input channels so that an input signal entered through the operator console of the host apparatus is inputted to the pager-use central processing unit. With this arrangement, even though the pager terminal device is attached to the host apparatus in a completely inserted manner thereinto, the pager terminal device is externally operable by using the operator console of the host apparatus. This arrangement makes it possible to avoid having to attach the pager terminal device in an awkward manner so as to make the key section exposed, that is, in an protruding manner from the host apparatus. Thus, any desirable styling design can be selected in manufacturing the pager terminal device as well as the host apparatus, without providing any specific structures and without any limitations to the location of the structures.

For a fuller understanding of the nature and advantages of the invention, reference should be made to the ensuing detailed description taken in conjunction with the accompanying drawings.

BRIEF DESCRIPTION OF THE DRAWINGS

FIG. 7 is a flow chart showing an input switching operation that is controlled by software.

DESCRIPTION OF THE EMBODIMENTS

Figure 1:
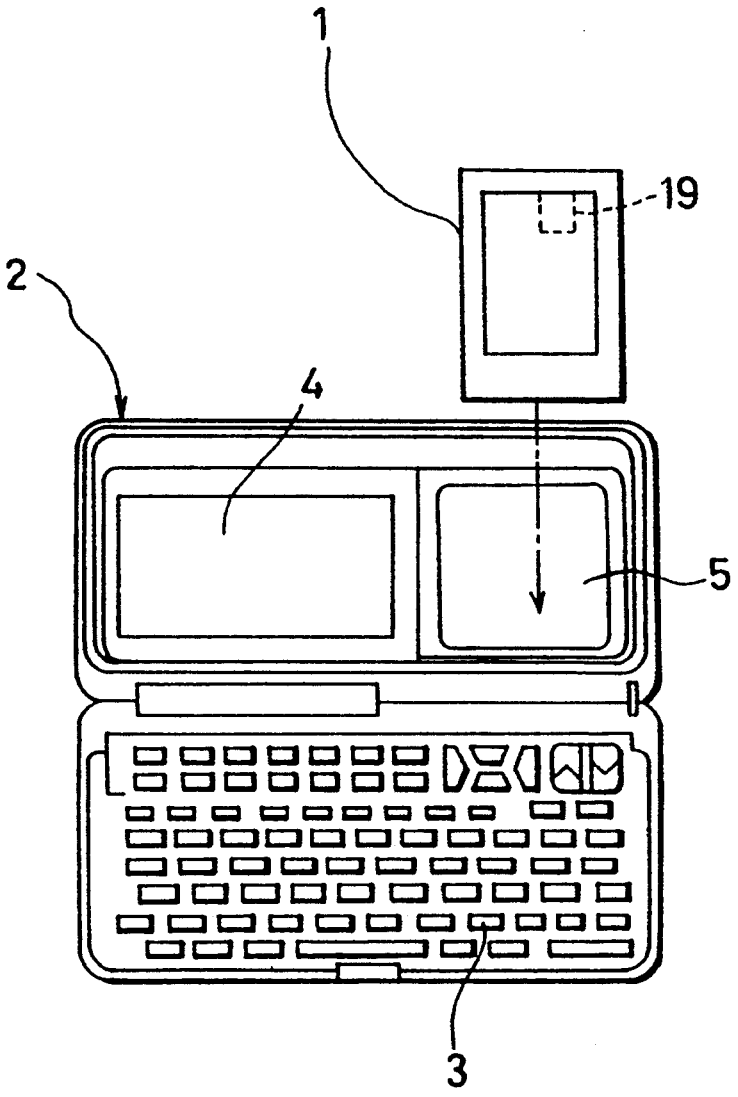
FIG. 1 is a plan view showing an outline of a host apparatus and a pager terminal device in accordance with the present invention.
Figure 2:
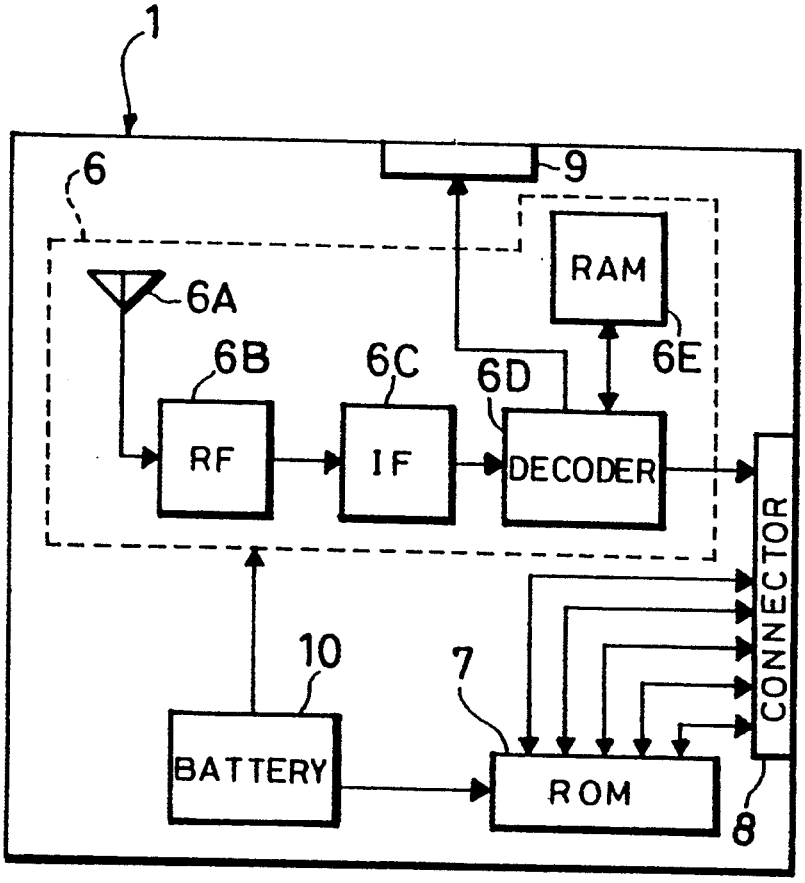
FIG. 2 is a block diagram showing one example of the internal structure of the pager terminal device of the present invention.
Figure 3:
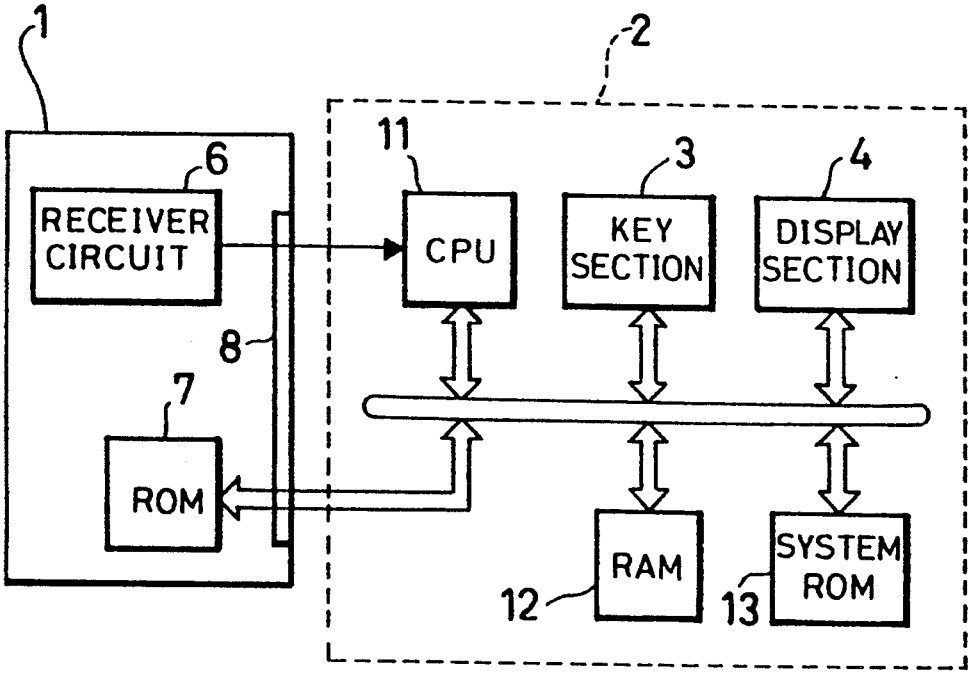
FIG. 3 is a schematic block diagram showing the connection between the pager terminal device and the host apparatus.

Referring to FIGS. 1 through 3, the following description will discuss one preferred embodiment of the present invention.

As illustrated in FIG. 1, a pager terminal device 1 of the present invention is housed in a sheet-like casing, and has the same shape as that of an IC card (Integrated Circuit). An electronic system notebook of pocket size is exemplified as a host apparatus 2 to which the pager terminal device 1 is connected. The electronic system notebook has an input-use key section 3 and a display section 4 as an operator console, as well as an IC card receiving section 5, and is also provided with a built-in signal processing system such as a central processing unit, which will be described later.

As illustrated in the block diagram of FIG. 2, the pager terminal device 1 is mainly constituted of a pager-use receiver circuit 6, a ROM 7 and a single connector 8, which are installed as integral parts thereof. The receiver circuit 6 receives pager-use data that are radioed from a pager relay base, and executes a predetermined signal processing. The ROM 7 stores a controlling program (application program) for the operation of the signal processing in the host apparatus 2, which forms an essential feature of the present invention. The connector 8 connects the ROM 7 and the receiver circuit 6 to the host apparatus 2 mechanically as well as electrically.

The receiver circuit 6 is constituted of: an antenna 6A, a radio frequency amplification section 6B and an intermediate frequency amplification section 6C, whereby pager-use data are received, amplified, etc.; a decoder 6D which converts the received pager-use data into signals that are processable in a computer; and a RAM 6E which functions as a buffer memory for temporarily storing the pager-use data. Further, the receiver circuit 6 is connected to the connector 8 through a serial interface (not shown).

The connector 8 is a single connecting section which is integrally provided with a terminal for connecting a data line for sending and receiving a signal between the pager terminal device 1 and the central processing unit of the host apparatus 2 and a terminal for connecting a data line for sending the pager-use data from the pager terminal device 1 to the host apparatus 2. The pager terminal device 1 is further provided with an annunciator section 9 made up of switches, display lamps, etc., and a battery 10 that forms a driving power source.

In this embodiment, since the pager terminal device 1 is provided with the RAM 6E for temporarily storing pager-use data, it can be used as an independent apparatus. In this case, the pager-use data are temporarily stored in the RAM 6E. Then, by connecting the pager terminal device 1 to the host apparatus 2, if necessary, the pager-use data are subjected to the signal processing in the host apparatus 2. Here, the pager terminal device 1 is not necessarily provided with the RAM 6E. Even in that case, no inconvenience arises except that the pager terminal device 1 is not used as an independent apparatus.

As illustrated in FIG. 3, when connected to the host apparatus 2, the pager terminal device 1 is allowed to use the functions of pager systems. That is, the host apparatus 2 takes pager-use data from the receiver circuit 6 via the connector 8 according to the application program in the ROM 7, and controls the system in such a manner that the pager-use data are temporarily stored in a RAM 12, or displayed on the display section 4 as characters or images in response to instructions entered through the key section 3. Here, a central processing unit 11 in the host apparatus 2 controls the entire system in accordance with a system controlling program that is stored in a system ROM 13.

As described above, the pager terminal device 1 is provided with the receiver circuit 6 and the ROM 7 for storing a software for effectively utilizing the pager-use data, both of which are connected to the host apparatus 2 by the use of the single connector 8. With this arrangement, the host apparatus 2 obtains combined functions of receiving and utilizing the pager-use data, and only requires one connecting section for permitting the pager terminal device 1 to achieve those functions. Thus, the host apparatus 2 requires no such complicated structure as to impair its portability.

Moreover, the central processing unit 11 of the host apparatus 2 controls the entire system, which is constituted of the pager terminal device 1 and the host apparatus 2, according to a software that is provided in the system ROM 13; therefore, it is only required for the pager terminal device 1 to install the ROM 7 for storing the application program. This arrangement makes it possible to reduce the cost of the pager terminal device 1.

Furthermore, only by attaching the pager terminal device 1 to the host apparatus 2, the user can access the functions of pager systems. Therefore, it is assured to prevent the occurrence of a conventional trouble such as an incorrect combination of application programs, that is, a trouble caused by using a pager terminal device in combination with an external storage device having an improper application program. Moreover, various pager terminal devices dedicated to specific uses are available by pairing the receiver circuit 6 with a specific application. Thus, by readily attaching and removing these pager terminal devices to and from the host apparatus 2, various applications are utilized according to the necessity.

Referring to FIGS. 4 through 7, the following description will discuss another preferred embodiment of the present invention.

Figure 4:
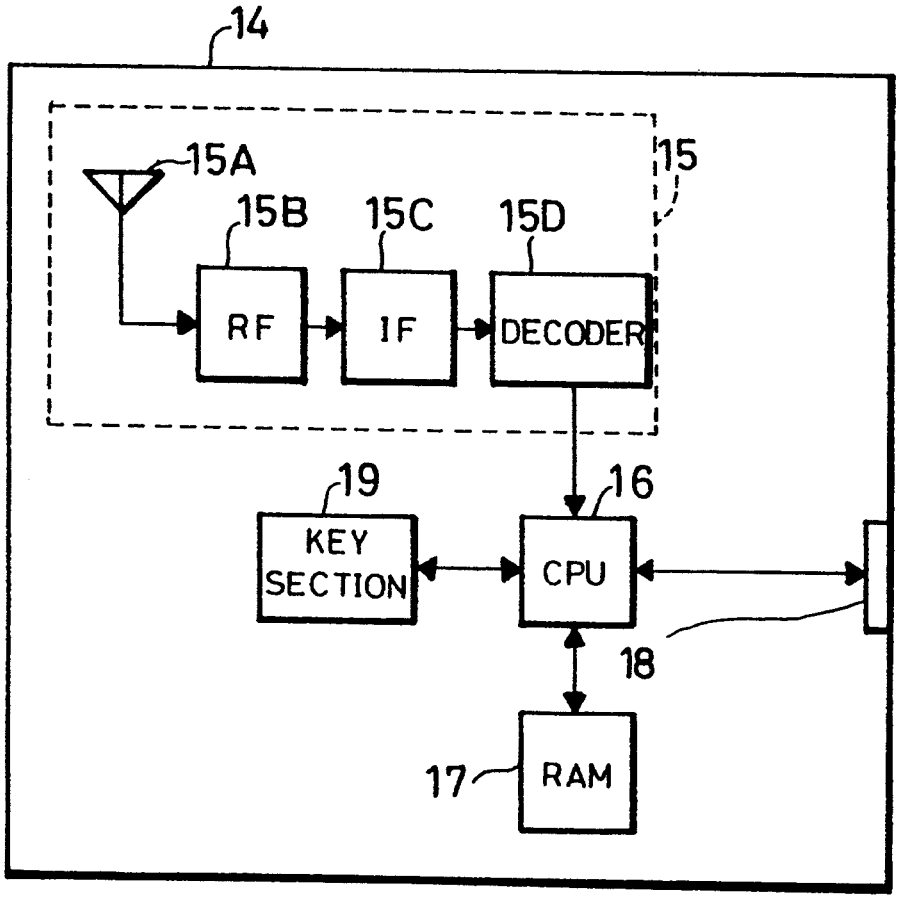
FIG. 4 is a block diagram showing another example of the internal structure of the pager terminal device of the present invention.

FIG. 4 shows a block diagram of a pager terminal device 14 of a type that is operative alone as one unit. The pager terminal device 14 is mainly constituted of a pager-use receiver circuit 15, an input operation key section 19, a central processing unit 16, a single connector 18, and a RAM 17.

The receiver circuit 15 receives pager-use data that are radioed from a pager relay base, and executes a predetermined signal processing. The input operation key section 19 is provided with keys such as a power key and an on-off key for alarm. The central processing unit 16, which is provided with a built-in ROM (not shown) storing a controlling program, processes a received signal from the receiver circuit 15 and an input signal entered through the key section 19 in accordance with the controlling program, thereby controlling the entire functions of the pager terminal device 14. The connector 18 connects the central processing unit 16 to the host apparatus 2 mechanically as well as electrically. The RAM 17 temporarily stores the pager-use data.

As in the foregoing embodiment, the receiver circuit 15 is constituted of: an antenna 15A, a radio frequency amplification section 15B and an intermediate frequency amplification section 15C, whereby pager-use data are received, amplified, etc.; and a decoder 15D which converts the received pager-use data into signals that are processable in a computer. The key section 19 is located, for example, at a position indicated by a dashed line in FIG. 1.

In addition to the above-mentioned components, the pager terminal device 14 is provided with a connection-discriminating circuit, which discriminates whether the connector 18 is connected to or disconnected from the host apparatus 2, and an input switching circuit for switching input channels with respect to the central processing unit 16. According to the results of discrimination made by the connection-discriminating circuit, the input channels are switched by the input switching circuit as follows: (i) When the connector 18 is not connected to the host apparatus 2, an input signal entered through the key section 19 of the pager terminal device 14 is supplied to the central processing unit 16. (ii) When the connector 18 is connected to the host apparatus 2, an input signal entered through a key section 3 that is installed on the operator console of the host apparatus 2 is supplied to the central processing unit 16.

Figure 5:
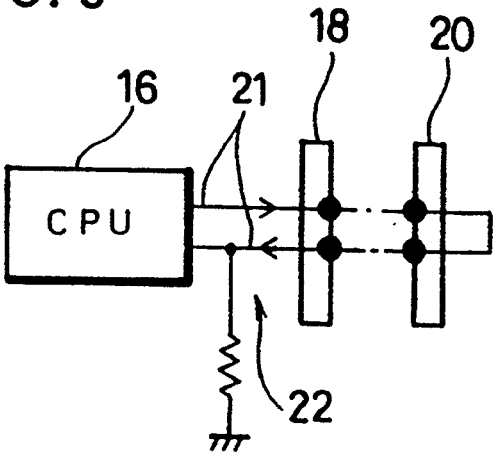
FIG. 5 is an explanatory drawing showing one example of a connection-discriminating circuit that is provided in the pager terminal device.

FIG. 5 shows one example of the arrangement of a connection-discriminating circuit 22. In this case, specific paired input and output ports of the central processing unit 16 are connected to two terminals of the connector 18 via a connection-discriminating signal conductor 21, and it is arranged to short-circuit two terminals of a connector 20 of the host apparatus 2, which are respectively connected to the two terminals of the connector 18. Here, the input port is connected to ground through a resistor.

The connection between the pager terminal device 14 and the host apparatus 2 is discriminated as follows: First, a signal with a voltage of high level is released from the output port of the central processing unit 16 via the connection-discriminating signal conductor 21. If this signal is returned to the input port of the central processing unit 16 via the connector 20, it is discriminated that the connection is maintained. On the contrary, if the input port remains at low level, it is discriminated that the connection is not made.

Here, two types of the input switching are available: by the use of hardware and software. The input switching using hardware is preferred in the case where the host apparatus 2 is provided with keys dedicated to pager systems, and has extra pins of the connector 20 that are used for connecting key matrix signal conductors. Except that case, the input switching using software is preferably adopted.

Figure 6:
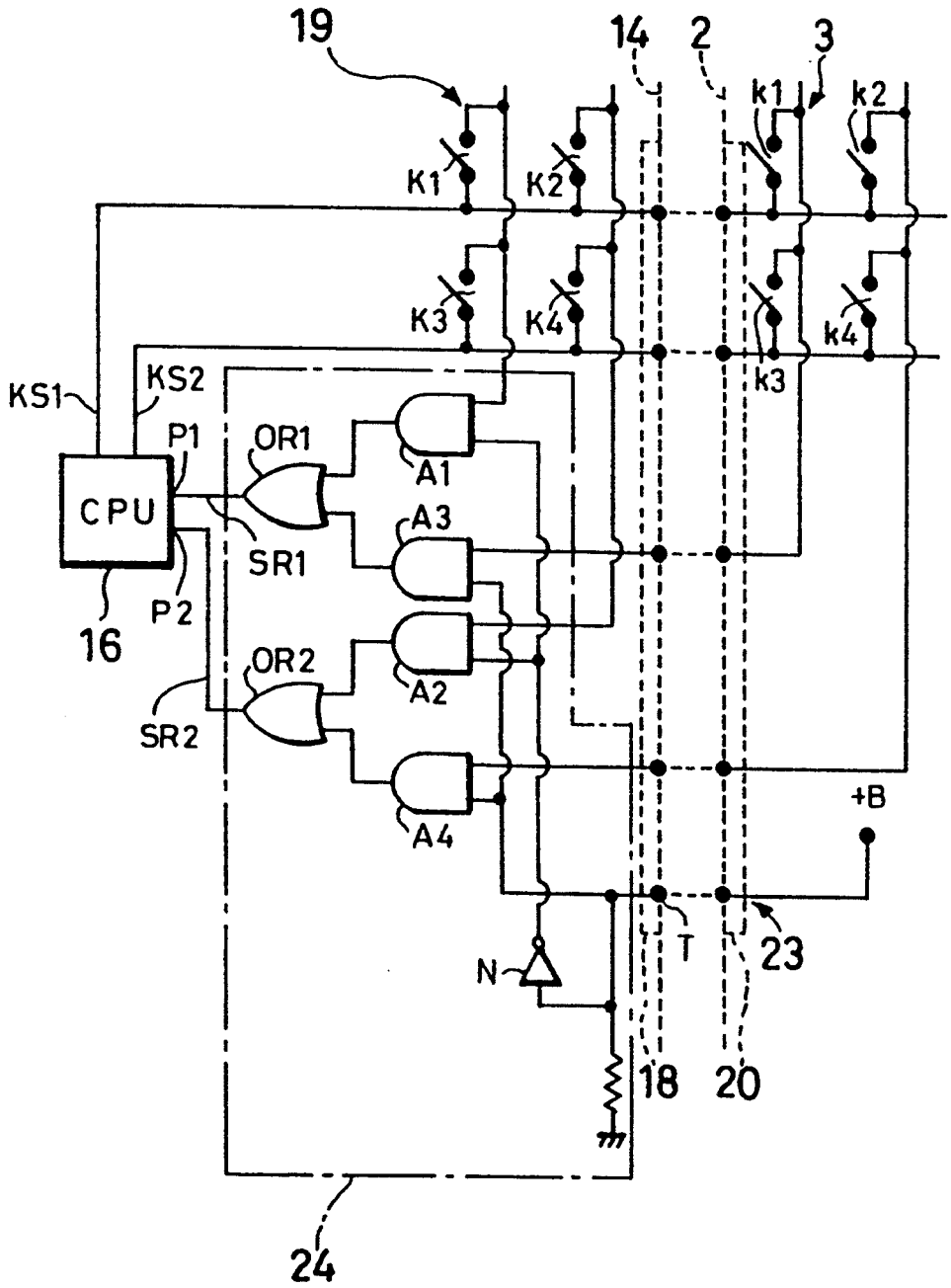
FIG. 6 is an electrical connection diagram of an input switching circuit that is assembled in hardware.

FIG. 6 shows an input switching circuit 24 which includes another connection-discriminating circuit 23 that is different from the above-mentioned connection-discriminating circuit 22. In this connection-discriminating circuit 23, a specific terminal T of the connector 18 is connected to input ports P1 and P2 of the central processing unit 16, and paired with a terminal of the connector 20, which is connected to a dc power source (+B). The central processing unit 16 of the pager terminal device 14 is always monitoring the voltages of the input ports P1 and P2, and discriminates that the pager terminal device 14 is connected to the host apparatus 2 by detecting the change of those voltages from low level to high level. Here, for convenience of explanation, FIG. 6 shows an arrangement wherein sets of four keys, K1 to K4 and k1 to k4, are respectively installed on the key section 19 of the pager terminal device 14 and the key section 3 of the host apparatus 2. Key strobe signals are released from the central processing unit 16 to the respective sets of keys, K1 to K4 and k1 to k4, through key strobing signal conductors KS1 and KS2. The key strobe signals are returned to the central processing unit 16 through key strobing return signal conductors SR1 and SR2 in response to operation of the respective sets of keys, K1 to K4 and k1 to k4. According to the results of discrimination made by the connection-discriminating circuit 23, the input switching circuit 24 switches the key strobing return signal conductors SR1 and SR2 so as to be connected to either the key section 19 or 3.

More specifically, in the case where the pager terminal device 14 is not connected to the host apparatus 2, the dc power source (+B) is not connected to the terminal T, thereby resulting in a voltage of low level at the terminal T. In this case, a voltage of high level is applied to either of the input terminals of each of the AND circuits A1 and A2 from a reversing circuit N; therefore, only the AND circuits A1 and A2, among the AND circuits A1 to A4 installed in the input switching circuit 24, are put to a state wherein a logical product is available. Since the other of the input terminals of each of the AND circuits A1 and A2 is connected to the key section 19 of the pager terminal device 14, the key strobe signal is returned to the central processing unit 16 through an OR circuit OR1 and the key strobing return signal conductor SR1 or through an OR circuit OR2 and the key strobing return signal conductor SR2 only when any one of the keys K1 to K4 of the key section 19 is turned on.

In the case where the pager terminal device 14 is connected to the host apparatus 2, the dc power source (+B) is connected to the terminal T, thereby resulting in a voltage of high level at the terminal T. In this case, a voltage of low level is applied to either of the input terminals of each of the AND circuits A1 and A2 from the reversing circuit N while a voltage of high level is applied to either of the input terminals of each of the AND circuits A3 and A4 that are connected the terminal T. Therefore, only the AND circuits A3 and A4 are put to a state wherein a logical product is available. Since the other of the input terminals of each of the AND circuits A3 and A4 is connected to the key section 3 of the host apparatus 2, the key strobe signal is returned to the central processing unit 16 in the same manner as the above-mentioned case only when any one of the keys k1 to k4 of the key section 3 is turned on.

Therefore, even in the arrangement wherein the pager terminal device 14 is completely inserted into the host apparatus 2, the pager terminal device 14 can be operated by the use of the key section 3 of the host apparatus 2. This arrangement makes it possible to avoid having to attach the pager terminal device 14 in an awkward manner such as to attach the pager terminal device 14 in a protruding manner from the host apparatus 2. As a result, any desirable styling design can be selected in manufacturing the pager terminal device 14 as well as the host apparatus 2 without any limitations.

Moreover, FIG. 7 shows a flow chart of an input switching process wherein the input switching is executed by using software. A controlling program for this input switching process is stored in the built-in ROM of the central processing unit 16 of the pager terminal device 14. The central processing unit 16, which is always monitoring the input voltage of the connection-discriminating port (S1), releases a key strobe signal (S3) when it discriminates that the input voltage is in low level (S2), and waits for an input of a key matrix signal entered from the key section 19 of the pager terminal device 14. More specifically, the central processing unit 16 successively discriminates whether there is an input of a key matrix signal released from the power-off key, the power-on key, the alarm-off key, or the alarm-on key (S4–S7) and executes a corresponding processing upon discriminating which key is operated (S8–S11).

Further, the central processing unit 16, when it discriminates that the pager terminal device 14 is connected to the host apparatus 2 upon receiving the high level of the input voltage of the connection-discriminating port (S12), switches the targets for the signal-input waiting and waits for an input from the host apparatus 2. Successively, the central processing unit 16 discriminates whether there is an input of a signal from the host apparatus 2 (S13), and waits for an input of a signal (S14). The following procedures are executed depending on the types of received input signals: For example, if a character of "K" is entered as the signal (S15), a predetermined processing is executed (S20); if the discrimination is made as receiving a character of "01" (S16), the off-process of the power source is executed (S21); if the discrimination is made as receiving a character of "02" (S17), the on-process of the power source is executed (S22); if the discrimination is made as receiving a character of "03" (S18), the off-process of the alarm is executed (S23); and if the discrimination is made as receiving a character of "04" (S19), the on-process of the alarm is executed (S24). Here, the central processing unit 11 of the host apparatus 2 is set in its program so that a predetermined signal is released to the pager terminal device 14 when any one of the keys k1 to k4 is operated.

Thus, in the case of executing the input switching by using a software, the pager terminal device 14 is also operated by the key section 3 of the host apparatus 2 with the pager terminal device 14 completely inserted into the host apparatus 2, thereby providing the same effects as described above.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A pager terminal device, which is connectable to a portable electronic host apparatus having a host central processing unit, a storage device for storing a system controlling program and an operator console, said terminal device comprising:

a receiver circuit for receiving and processing a radio signal that is released from a pager relay base;

a key section through which instructions are entered to the pager terminal device;

a pager-use central processing unit for controlling the entire pager terminal device in accordance with a built-in controlling program that is provided therein;

a connector for connecting the receiver circuit to the host apparatus mechanically as well as electrically;

connection-discriminating means for discriminating whether the connector is connected to or disconnected from the host apparatus; and input switching means for switching input channels in such a manner that an input signal entered through the key section is supplied to the pager-use central processing unit when the discrimination result of the connection-discriminating means shows "disconnection" and that an input signal entered through the operator console is supplied to the pager-use central processing unit when the discrimination result of the connection-discriminating means shows "connection".

2. The pager terminal device as set forth in claim 1, wherein the connection-discriminating means includes means for returning a signal released from an output port of the pager-use central processing unit to an input port of the pager-use central processing unit when the connector is connected to the host apparatus.

3. The pager terminal device as set forth in claim 1, wherein the input switching means includes:

a first key strobing signal conductor for transmitting a key strobe signal released from the pager-use central processing unit to the key section;

a second key strobing signal conductor for transmitting the key strobe signal to the operator console;

a first return means for returning the key strobe signal to the pager-use central processing unit upon operation of the key section when the discrimination result shows "disconnection"; and a second return means for returning the key strobe signal to the pager-use central processing unit upon operation of the operator console when the discrimination result shows "connection",

4. The pager terminal device as set forth in claim 1, wherein the connection-discriminating means includes means for allowing voltage of a specific terminal of the connecter to become high when the connector is connected to the host apparatus.

5. The pager terminal device as set forth in claim 4, wherein the input switching means includes connection switching means for switching the connections of the key section and the pager-use central processing unit to provide an effective connection and an ineffective connection as well as switching the connections of the operator console and the pager-use central processing unit to provide an effective connection and an ineffective connection, in response to the voltage of the specific terminal.

6. The pager terminal device as set forth in claim 5, wherein the connection switching means includes:

a reversing circuit whose input is connected to the specific terminal;

a first AND circuit having a first input and a second input, the first input being connected to the key section, the second input being connected to an output of the reversing circuit; and a second AND circuit having a third input and a fourth input, the third input being connected to the operator console, the fourth input being connected to the specific terminal.

7. The pager terminal device as set forth in claim 6, wherein the connection switching means further includes:

an OR circuit having a fifth input, a sixth input, and an output, the fifth input being connected to an output of the first AND circuit, the sixth input being connected to an output of the second AND circuit, the output being connected to the pager-use central processing unit.

8. The pager terminal device as set forth in claim 1, further comprising a RAM for temporarily storing data that have been signal-processed in the receiver circuit.

9. The pager terminal device as set forth in claim 1, wherein the receiver circuit comprises conversion means for converting a received radio signal into data that are processable in the central processing unit of the host apparatus.

10. The pager terminal device as set forth in claim 1, wherein the pager-use central processing unit includes:

a connection-discriminating port;

means for always monitoring an input voltage of the connection-discriminating port;

means for releasing a key strobe signal to the key section in response to the input voltage of the connection-discriminating port;

means for discriminating presence or absence of an input of a key matrix signal from the key section; and means for executing a processing in response to an operation on the key section.

11. The pager terminal device as set forth in claim 1, wherein the pager-use central processing unit includes:

a connection-discriminating port;

means for always monitoring an input voltage of the connection-discriminating port;

means for discriminating presence or absence of a signal input from the host apparatus in accordance with the input voltage of the connection-discriminating port; and means for executing a corresponding processing in response to the signal from the host apparatus.

12. The pager terminal device as set forth in claim 1, wherein the host apparatus is a pocket-size electronic system notebook.

* * * * *